US005407017A

United States Patent [19]

Wehr et al.

[11] Patent Number: 5,407,017

[45] Date of Patent: Apr. 18, 1995

[54] HAMMER FOR REMOVING GATES OR RISERS FROM CASTINGS

[75] Inventors: Craig M. Wehr; Ralph B. Tempel, both of Waterloo; Basil Law, Charles City; Doyle V. Bass, Waterloo, all of Iowa

[73] Assignee: Deere & Company, Moline, Ill.

[21] Appl. No.: 179,853

[22] Filed: Jan. 11, 1994

[51] Int. Cl.[6] ..... B25B 28/00; B25D 9/00

[52] U.S. Cl. ..... 173/54; 173/114; 173/115; 173/202

[58] Field of Search ..... 173/53, 54, 114, 115, 173/120, 202; 29/252, 798; 91/41; 92/15; 227/132

[56] References Cited

U.S. PATENT DOCUMENTS

| | | | |
|---|---|---|---|
| 3,177,952 | 4/1965 | West | 173/121 |
| 3,181,626 | 5/1965 | Sussman | 173/53 |
| 3,268,013 | 8/1966 | Sussman | 173/53 |

OTHER PUBLICATIONS

Literature from Hitachi of Japan, four pages, date unknown, but before date of present invention.

Publication from Maschinenfabrik of Fernruf, Germany, five pages, date unknown, but before date of present invention.

*Primary Examiner*—Rinaldi I. Rada
*Assistant Examiner*—Jay Stelacone

[57] ABSTRACT

An air-operated hammer is provided for removing risers or gates from castings. The hammer includes a piston having a rod to which an impact member is releasably latched. Operation of the piston is controlled by a pneumatic logic control circuit, the operation of which is initiated by simultaneously depressing a pair of thumb-operated pneumatic switches. When actuated, the control circuit acts to cause the piston to retract to cause the impact member to compress one or more blow-delivery springs, with the latch being automatically released, upon desired loading being achieved, to permit the release of the stored energy in the springs resulting in the impact member being impelled against a gate or riser to be broken off. Meanwhile, the circuit operates to reverse the direction of movement of the piston so that it extends to be automatically once again latched to the impact member. The circuit then operates to cause the piston to once again reverse its direction with the cycle of operation being completed once the impact member meets the resistance of the blow-delivery springs.

13 Claims, 6 Drawing Sheets

140
142
144
146
148
150
152
154
156
158
160
162
164
166
168
170
172
174
176
178
180
182
184
186
188
190
192
194
196
198
200
202
206
208
210
212
214
216
218
220
222
223
224
226
228
230
232
234
236
238
240
242
14
24
28
30

HAMMER FOR REMOVING GATES OR RISERS FROM CASTINGS

BACKGROUND OF THE INVENTION

The present invention relates to implements for degating or removing the risers from castings and more specifically relates to hammers used for such removal.

It is common practice to manufacture iron castings, such as ductile iron castings, with large iron risers attached to critical areas of the castings to eliminate casting shrinkage during cooling. Risers are typically broken off manually by means of a sledge hammer. These large risers often require numerous blows to be applied to them in order to separate them from the casting and thus making the "cleaning" up of the castings a labor-intensive procedure resulting in increased manufacturing cost. Another problem with using sledge hammers for removing gates and risers from castings is that the castings must cool down for an extended length of time after being removed from the mold so that the metal will break instead of tear when hit with a sledge hammer.

Furthermore, wielding large hammers to break off chunks of iron is not a particularly safe activity requiring the work space to be cleared of and shielded from other personnel; and even with adequate training and instruction a worker is apt to undergo injury due to misdirected blows which result in inordinate stresses on the body or due to getting struck by metal pieces that take unusual trajectories when they break from the casting.

While powered devices such as hydraulic wedges, hydraulic reams, rotating table mill heads, hydraulic concrete breakers and metal shears are being used by foundries to remove gates or risers from castings, each has limitations to general use in the degating process.

SUMMARY OF THE INVENTION

According to the present invention there is provided a powered device for removing gates or risers from castings and, more specifically, there is provided a powered hammer for performing such function.

An object of the invention is to provide a device which allows an operator to easily remove risers of various sizes from castings without the operator becoming unduly fatigued.

A more specific object of the invention is to provide a powered hammer, of relatively simple design, which is more efficient than hand wielded hammers in removing casting risers and is capable of breaking off these risers without requiring the castings to undergo prolonged cooling after being removed from the mold.

Yet a more specific object of the invention is to provide a powered hammer having a pneumatically shiftable, two-way piston having a rod to which a blow delivering nose-piece is releasably connected, the piston loading the nose-piece against coil compression springs which, upon release of the nose-piece from the piston rod, drive the nose-piece to impact a casting riser to be broken off.

Still another object of the invention is to provide, in conjunction with a hammer as set forth in the previous object, a control circuit for routing pressurized air to and exhausting air from the hammer piston so as to automatically cause the hammer to go through an operating cycle where the piston rod together with the releasably attached nose-piece is initially retracted to load the nose-piece against compression springs, with the nose-piece then being released to strike a blow to the riser being removed, followed by the piston extending to again become releasably attached to the nose-piece and finally by the piston beginning it's retraction stroke and stopping in response to the nose-piece contacting the unloaded compression springs.

These and other objects will become apparent from a reading of the ensuing description together with the appended drawings.

DESCRIPTION OF THE PREFERRED EMBODIMENT

Figure 1:
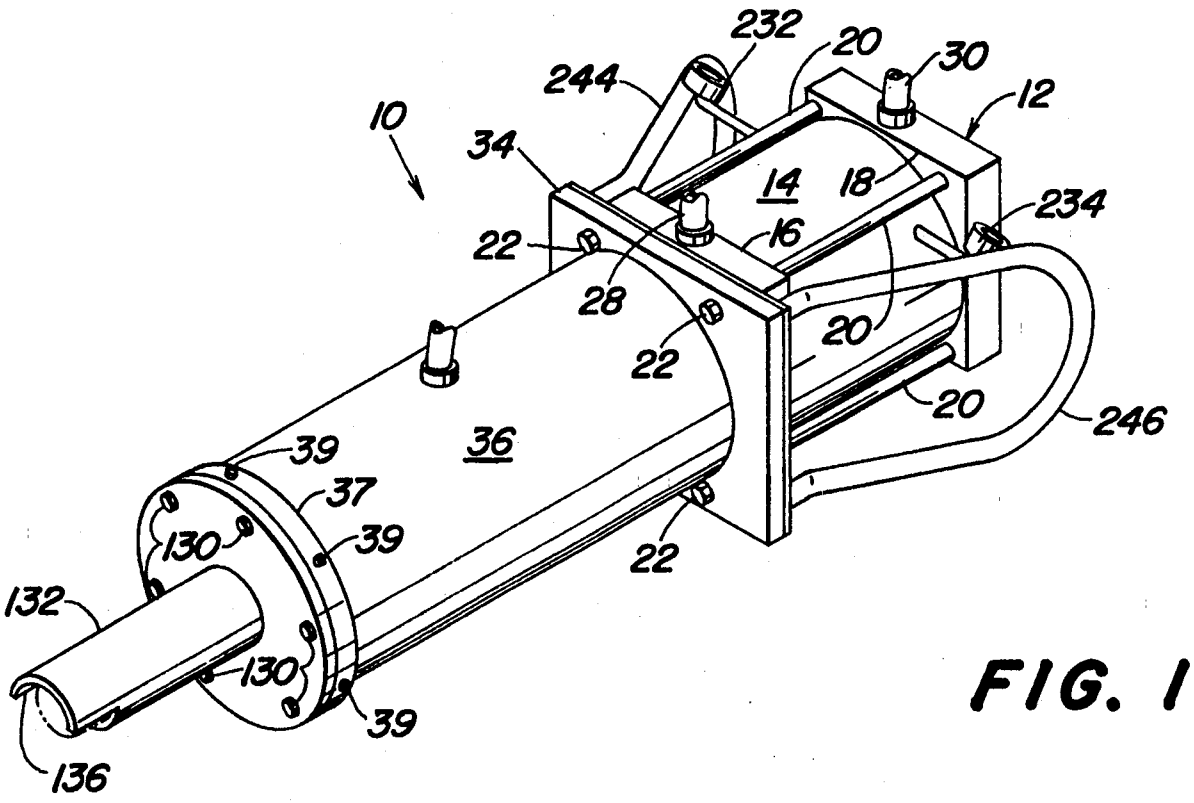
FIG. 1 is a left front perspective view, with portions broken away, of a powered hammer constructed in accordance with the principles of the present invention.

Referring now to FIG. 1, there is shown a pneumatically operated degating hammer 10 comprising a pneumatic piston and cylinder unit 12. The unit 12 includes a cylinder 14 located between front and rear end plates 16 and 18, respectively, that are clamped against opposite ends of the cylinder by a plurality of tie bolts 20 extending through the plates and having threaded ends receiving nuts 22. Slidably received in the cylinder 14 is a piston 24 (FIGS. 6–9) to which is fixed a forwardly projecting piston rod 26. The front and rear end plates 16 and 18 are each provided with an air passage (not shown) which leads into the cylinder 14 such that air may be selectively controlled to enter the cylinder at one side of the piston while being exhausted from the other side of the piston. A first pressure/return line 28 is connected to the air passage provided in the front plate 16 while a second pressure-return line 30 is coupled to the air passage provided in the rear end plate 18.

Figure 4:
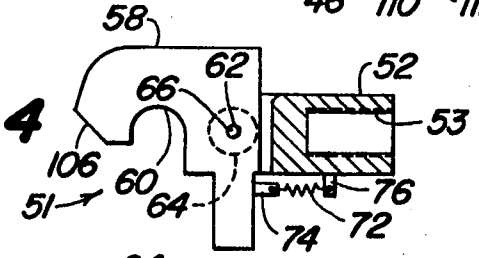
FIG. 4 is a partial sectional view of the latch hook assembly.

Referring now also to FIG. 4, it can be seen that secured to the front cylinder end plate 16, as by a plurality of cap screws 32, is a rectangular, rear spring guide retainer plate 34. A cylindrical housing 36 has its rear end welded to the plate 34 and a circular mounting ring 37 is welded about the periphery of the forward end of the housing 36. A front, cylindrical spring guide retainer plate 38 is secured in the forward end of the housing 36 by a plurality of cap screws 39 extending through aligned holes provided in the mounting ring 37 and housing and threaded into holes provided in the retainer plate 38. A set of six equi-angularly spaced holes 40 are in the rear guide retainer plate 34 while a similar set of holes 42 is provided in the front guide retainer plate 38, with the holes of one plate being in axial alignment with the holes in the other plate. A spring guide rod 44 is received in each of the aligned pairs of holes of the sets of holes 40 and 42. Received on each of the guide rods 44 is a pair of hammer blow delivery springs 46, in the form of coil compression springs, which may be energized for delivering a hammer blow, in a manner described below. Also, received on each spring guide rod 44 forwardly of the associated springs 46 is a recoil spring 48, which is also in the form of a coil compression spring.

The piston rod 26 projects through an opening provided centrally in the rear guide retainer plate 34 and terminates in a reduced diameter threaded forward end portion 50. A latch hook assembly 51 (FIG. 4) includes an elongated latch hook mounting block 52 having a threaded bore 53 provided in the rear and along the major axis thereof and the block is screwed onto the piston rod end 50. A rectangular slot 54 is provided in the forward end of the block 52 thus bifurcating the forward end of the block into separate legs 56. An inverted, roughly J-shaped latch hook 58 is received in the slot 54. As considered in its latched position shown in FIGS. 2 and 4, the latch hook 58 has a downwardly opening, substantially semi-circular receptacle 60 located in the hook of the J at a location substantially on the axis of the piston rod 26. The latch hook 58 is provided with a mounting hole 62 also located on the centerline of the piston rod 26 at a site between the receptacle 60 and the front end of the piston rod. Provided in each of the legs 56 of the mounting block 52 so as to be in axial alignment with each other is a throughbore 64 (FIG. 4) which defines a receptacle for receiving a bearing (not visible). A mounting pin 66 is tightly received in the mounting hole 62 of the latch hook 58 and has its opposite ends respectively received in the bearings such that the latch hook and mounting pin pivot together during operation, in a manner described below. A pair of thin, square, pin retainer plates 68 (FIG. 3) are each fastened by four screws 70 to opposite sides of the mounting block 52 in blocking relationship to the throughbores 64 and, hence, to the opposite ends of the mounting pin 66. Provided for resiliently resisting upward or clockwise rotation of the latch hook 58 is a tension coil spring 72, with a hook at the forward end of the spring being received in a cross hole provided in a post 74 screwed into a threaded hole located in the back side of the stem of the J of the latch hook and with a hook at the rearward end of the spring being received in a cross hole provided in a post 76 screwed into a threaded hole located in the underside of the mounting block 52.

Figure 5:
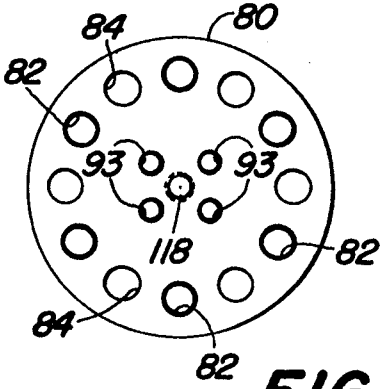
FIG. 5 is a front elevational view of the spring load plate.

An impact member or nose 78 is releasably attached to the piston rod 26 by means of the latch hook 58. Specifically, the impact member 78 includes a circular spring load plate 80 provided with six equi-angularly spaced holes containing respective guide bushings 82 slidably received on the spring guide rods 44 at a location between the blow delivery springs 46 and the recoil springs 48. Located between the bushings 82 are a plurality of air vent holes 84 (FIG. 5) having a purpose explained below. A latch roller assembly 86 is attached to the rear side of the load plate 80 and a blow-delivering rod 88 is attached to and extends forwardly from the plate 80. The roller assembly 86 includes a pair of laterally spaced roller mounting blocks 90, each having a flat forward end surface engaged with the plate 80 and provided with a pair of threaded holes, located one above the other. Screws 92 project rearwardly through holes 93 (FIG. 5) provided in the plate 80 and are threaded into the holes of the blocks 90. Rearward portions 94 of upper and lower flat edge surfaces of each block 90 converge rearwardly while the rear portion of respective confronting flat side surfaces 96 of each block are beveled to form an upright guide surface 98. Located just ahead of the guide surface 98 of each block 90 is a pin mounting bore 100, these bores being coaxial. A roller mounting pin 102 extends through the bores 100 and rotatably mounted on the pin 102 in a location between the blocks 90, is a latch roller 104. The forward end of the hook of the J of the latch hook 58 is provided with a forwardly facing ramp surface 106 that serves to lift the latch hook 58 upwardly against the action of the spring 72 and over the roller 104 so that the latter enters the receptacle 60 to latch the nose to the pneumatic cylinder piston rod 26 when the piston 24 is shifted forwardly.

Located in the path of the stem of the J of the latch hook 58 so as to trip the latch when the piston rod 26 is retracted is a trip block 108 that is adjustably fixed to a rear bottom location of the cylindrical housing 36. Specifically, a fore-and-aft elongated adjustment slot 110 is provided in the bottom of the housing 36 and a pair of screws 112 extend upwardly through the adjustment slot and are threaded into fore-and-aft spaced holes in the trip block 108. A cushion block 114 made of elastomeric material is fixed to an upper location of the interior of the housing 36 so as to be contacted by the latch hook 58 when the latter is rotated counterclockwise after coming into contact with the trip block 108 during retraction of the piston rod of the pneumatic cylinder. The cushion block 114 is provided with a pair of throughbores and associated counterbores and is held in place by a pair of screws 116 threaded into a pair of fore-and-aft spaced holes provided in the top of the housing 36.

The spring load plate 80 is provided with a central threaded hole 118 and received therein is a rear threaded, reduced in diameter portion 120 of a cylindrical hammer rod 122. Releasably secured to the forward end of the rod 122, as by cap screws 124, is a hardened nose piece 126. The hammer rod 122 extends forwardly from the plate 80 through openings provided centrally in the front spring guide rod retainer plate 38 and in a front end plate 128 that is fastened to the mounting ring 37 by a plurality of screws 130. The hammer rod 122 is also located within a cylindrical probe 132 secured to the forward end of the housing 36 by a plurality of screws 134 extending through aligned holes provided in the plates 38 and 128. As viewed from the side, the bottom of a forward end portion of the probe 132 is removed so as to form an arcuate gauge portion 136 which an operator can use to bring the hammer into striking distance of a riser desired to be removed from a casting, it being noted that the distance the hammer travels during the delivery of a blow carries the nose piece 126 to the end of the probe 132, as shown in dashed lines in FIG. 2.

Figure 2:
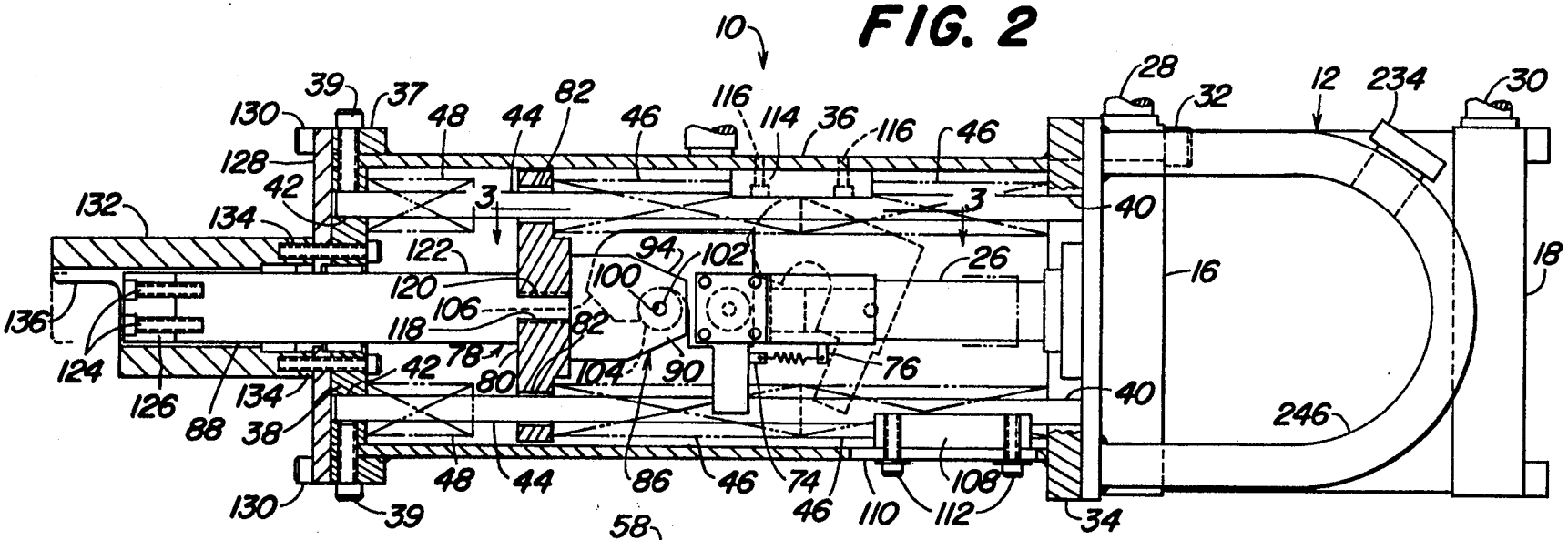
FIG. 2 is a longitudinal sectional view of the powered hammer showing the latter in its starting position with the hammer nose-piece releasably latched to the rod of a piston which is retracted to the point where it is just beginning to compress the hammer nose-piece propelling springs.
Figure 3:
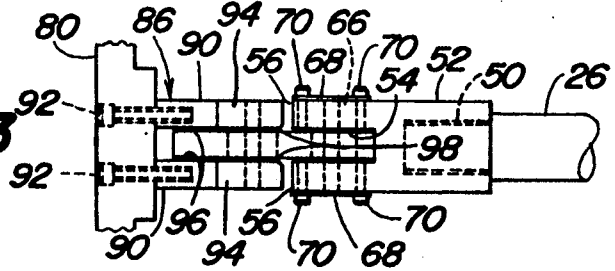
FIG. 3 is a top view showing the interconnection between the nose-piece and the piston rod.

Thus, it will be appreciated that when the impact hammer nose assembly 78 is latched to the piston rod 26, as shown in FIG. 2, retraction of the piston and cylinder unit 12 will cause the spring load plate 80 to compress the blow delivery springs 46. When the stem of the inverted J-shaped latch hook 58 engages the trip block 108, the nose assembly 78 will be released and the energy stored in the blow delivery springs 46 will propel the assembly 78 forwardly. Forward motion of the spring load plate 80 will be halted upon the plate engaging the recoil springs 48.

Figure 6:
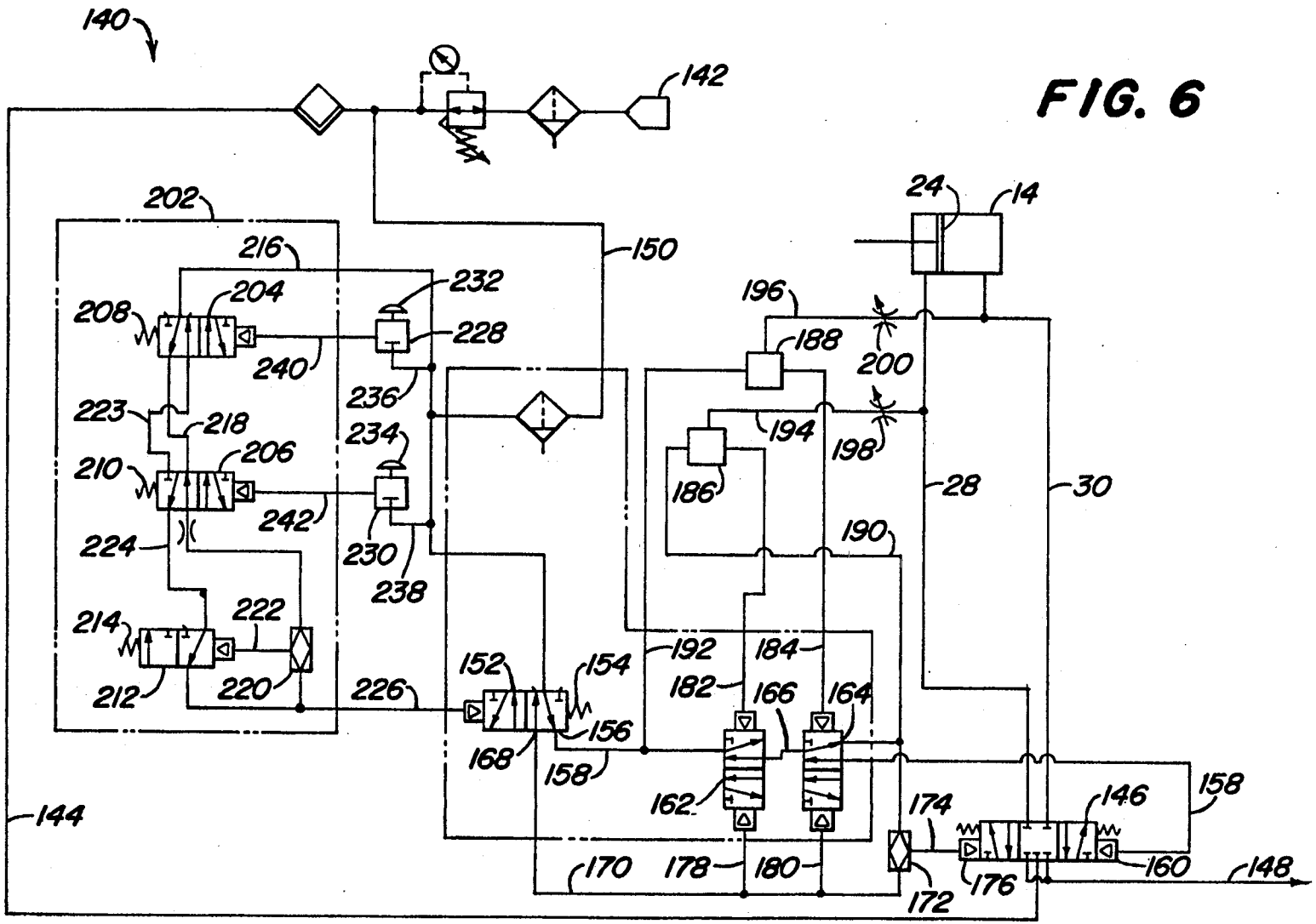
FIGS. 6–9 are schematic representations of the pneumatic control circuit for the hammer respectively showing the condition of the circuit at different phases of the operating cycle of the hammer.

Referring now to FIGS. 6–9, there is schematically shown a control circuit 140 for controlling the operation of the pneumatic piston and cylinder unit 12. The circuit 140 includes an air supply 142 connected to a cylinder operating air supply line 144 that leads to an input port of a three position, pilot-operated direction control valve 146. A pair of air exhaust ports of the valve 146 are coupled to an exhaust line 148 that is, in turn, coupled to the cylindrical spring housing or chamber 36 for cooling the sets of springs 46 and 48. The pressure/return lines 28 and 30 are respectively connected between a pair of pressure/return ports of the valve 146 and the rod and head ends of the air cylinder 14. When the direction control valve 146 is in a normal spring-centered, neutral position, as shown in FIG. 6, the supply line 144 is blocked from communication with either of the supply/return lines 28 and 30, the latter also being blocked from communication with the exhaust line 148.

Figure 8:
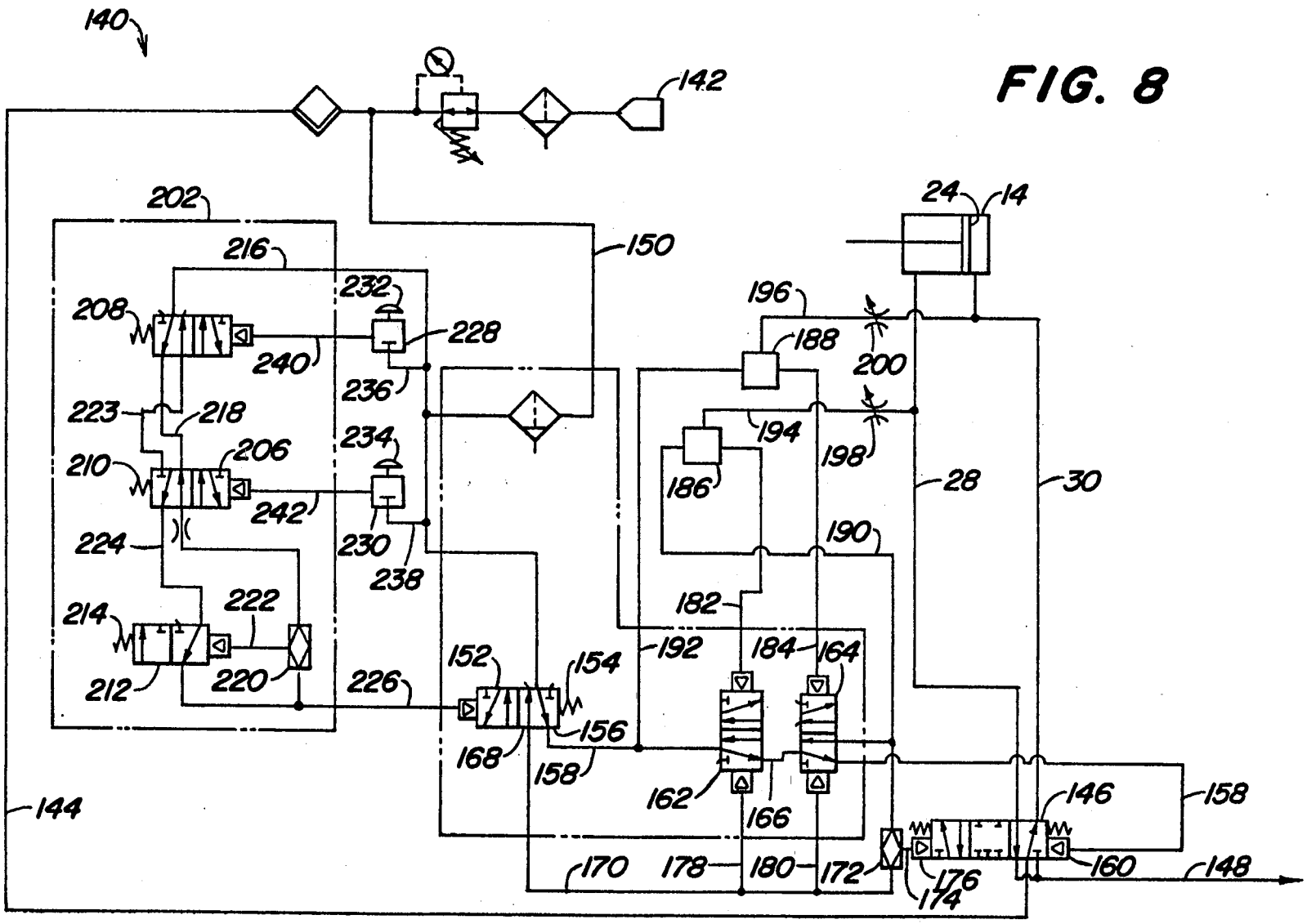

Branching from the cylinder operating air supply line 144 is a pilot air supply line 150 that leads to an inlet port of a pilot-operated, two-position pilot pressure control valve 152 shown in FIG. 6 in a normal leftward position to which it is biased by a spring 154. This inlet port is located between two exhaust ports that are open to the atmosphere. When the control valve 152 is in its normal position, the pilot air supply line 150 is communicated with an extend port 156 of the valve, the latter being connected to an extend pressure supply/return line 158 leading to an extend controller 160 at the right-hand end of the direction control valve 146. Connected in series with each other in the supply/return line 158 are identical left-and right-hand, two-position, pilot air operated valves 162 and 164. These valves have respective ports interconnected by a line 166. Pilot pressure flow to the right-hand controller 160 of the valve 146 for shifting the latter leftwardly to an extend position is permitted when both valves 162 and 164 are shifted upwardly, as shown in FIG. 8. In this position of the valve 146, the operating air supply line 144 is coupled to the pressure/return line 30 while the pressure/return line 28 is connected to the exhaust line 148, thus establishing a condition for extending the piston and cylinder unit 12.

Figure 7:
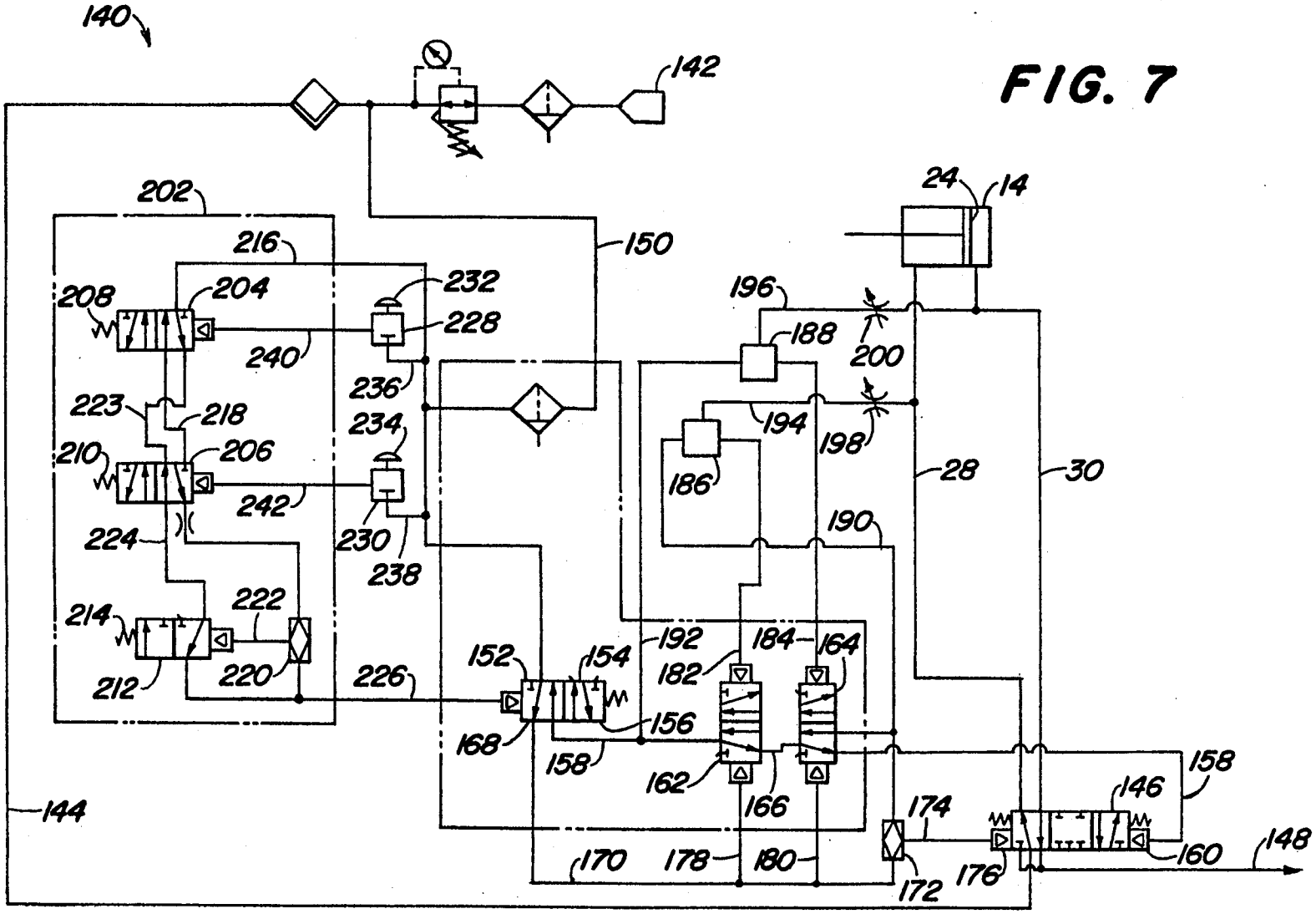

When a logic circuit, described below, provides an output signal pressure to a controller at the left-hand end of the control valve 152, the valve 152 shifts to a rightward position, as shown in FIG. 7, wherein it places the pilot pressure supply line 150 in communication with a retract port 168. A pilot air feed line 170 connects the retract port 168 to the bottom port of a shuttle valve 172 having a middle port coupled, as by a line 174, to a retract controller 176 at the left-hand end of the control valve 146. Thus, when the pilot pressure control valve 152 is in its rightward shifted position, pilot pressure is routed to the controller 176 to effect shifting of the control valve 146 to a retract position wherein it connects the operating air supply line 144 to the pressure/return line 28 while connecting the exhaust line 148 to the pressure/return line 30 so as to effect retraction of the piston and cylinder unit 12.

Provided for conveying pilot air for effecting the positioning of the pilot-operated control valves 162 and 164 is a pair of lines 178 and 180 branching from the feed line 170 and being respectively connected to controllers located at the bottom of the valves 162 and 164; and a pair of lines 182 and 184 respectively coupled between upper controllers of the valves 162 and 164 and outlet ports of lower and upper pneumatic pressure switches 186 and 188. The lower switch 186 has a pilot pressure inlet port connected, as by a branched line 190, to another port of the valve 164 and an upper port of the shuttle valve 172. The upper switch 188 has a pilot pressure inlet port connected, as by a line 192, to the pilot pressure feed line 158 at a point between the control valves 152 and 162. The pressure switches 186 and 188 also include respective sensed-pressure receiving ports respectively coupled, as by sensing lines 194 and 196, to the pressure/return lines 28 and 30 which respectively lead to the rod and head ends of the cylinder 14. Variable restrictors 198 and 200 are respectively located in the sensing lines 194 and 196 for controlling the pressure at which the switches 186 and 188 will trip. Thus, if air pressure is present in the line 190 when the pressure switch 186 is tripped, this pressure is routed to the top controller of the control valve 162 by way of the line 182 and acts to effect downward shifting of the valve 162. Similarly, if air pressure is present in the line 192 when the pressure switch 188 is tripped, this pressure is routed to the top controller of the control valve 164 by way of the line 184 and acts to effect downward shifting of the valve 164.

The flow of pilot pressure to the controller of the pilot pressure control valve 152 is controlled by a logic circuit 202. Specifically, the logic circuit 202 includes upper and lower identical, two-position pilot-operated valves 204 and 206, respectively, which are biased to normal rightward shifted positions by respective springs 208 and 210 at the left-hand ends of the valves. Located beneath the valve 206 is a further two-position, pilot-operated valve 212 that is biased to a normal rightward shifted position by a spring 214 at the left-hand end of the valve. Air is supplied to the logic circuit 202 by a logic air supply line 216 that branches from the pilot air supply line 150 and leads to an inlet of the upper two-position, pilot-operated logic valve 204. When the logic valves 204 and 206 are in their respective normal positions, as shown in FIG. 6, the logic air supply line 216 is connected to the logic valve 206 by way of a line 218 connected between the valves 204 and 206. In turn, the line 218 is connected to an upper port of a shuttle valve 220 having an outlet port coupled, as by a line 222, to a controller at the right-hand end of the valve 212. A second line 223 is interconnected between the logic valves 204 and 206. A line 224 is connected between the valves 206 and 212. When the controller of the valve 212 receives air pressure, the valve 212 will shift to a leftward actuated position, as shown in FIG. 6, wherein it connects the line 224 in communication with a line 226 leading from the logic circuit 202 to convey an output signal pressure to the controller of valve 152. The line 226 has a branch coupled to a lower port of the shuttle valve 220.

Pilot air for controlling the respective positions of the two logic valves 204 and 206 is respectively controlled by upper and lower, manually operable, on-off valves 228 and 230 which respectively include manually operable push buttons 232 and 234. The valves 228 and 230 have respective inlets connected to the pilot air supply line 150 by branches 236 and 238 and have respective outlets connected, as by lines 240 and 242 to controllers of the logic valves 204 and 206. As will be described in more detail below, the logic circuit 202, which is known in the art, operates to supply an output signal or pilot pressure to the line 226, and, hence to the controller of the pilot pressure control valve 152, if and only if the push buttons 232 and 234 are depressed approximately simultaneously so as to establish input signals or pilot pressure to the controllers of the logic valves 204 and 206. It is here noted that the push buttons 232 and 234 are located on or adjacent to right and left handles 244 and 246 (FIG. 1), at the rear end of the hammer 10, so as to be easily depressed by the thumbs of an operator while gripping the handles.

OPERATION

A complete cycle of the operation of the hammer 10 is as follows. At the beginning of a cycle, the latch hook 58 is latched to the roller 104 so that the impact member or nose 78 is coupled to the piston rod 26 and the latter is retracted to the point where the spring load plate 80 has just began to compress the hammer blow delivery springs 46. Therefore, no or very little stored energy exists in the hammer 10, which is desirable from a safety standpoint when the hammer is not in use or is in a standby condition. At this time the pneumatic control circuit 140 is in the condition illustrated in FIG. 6 wherein the direction control valve 146 for the cylinder and piston unit 12 is in its spring-centered, neutral position. It is here noted that the pilot air control valves 162 and 164 are now each in downward shifted positions connecting the right-hand controller 160 of the valve 146 to atmosphere, by way of the line 158, and connecting the left-hand controller 176 of the valve 146 to atmosphere, by way of the line 174, upper port of the shuttle valve 172 and line 190. It is further noted that the lower port of the shuttle valve 172 is connected to atmosphere by way of the line 170 and valve 152. Thus, no pressure is present in the left-hand controller 176 of the valve 146. Also, at this time the push buttons 232 and 234 of the manually operable, on-off valves 228 and 230 will be released so that no input signals are connected to and no output signal is established by the logic circuit 202. Thus, no signal pressure air is connected to the controller of the valve 152.

The operating cycle of the hammer 10 is initiated by the operator by simultaneously depressing the buttons 232 and 234 of the on-off valves 228 and 230 once the hammer 10 is properly positioned with the gauge portion 136 of the cylindrical probe 132 resting upon a casting riser to be broken off from the remainder of the casting. Once the push buttons 232 and 234 are depressed, input signal or pilot air is routed to the controllers at the right-hand ends of the logic valves 204 and 206 and causes the valves to shift leftwardly against the action of the springs 208 and 210. As can be seen in FIG. 7, this positioning of the logic valves 204 and 206 results in an output signal being established in the line 226, and hence, to the controller at the left-hand end of the pilot air control valve 152 and causes the latter to shift rightwardly to its retract position wherein it connects the pilot air supply line 150 in communication with the pilot air feed line 170 so that pilot air is fed, by way of the branch lines 178 and 180, to the respective bottom controllers of the valves 162 and 164 to shift them to their respective "up" positions so that they act in conjunction with the valve 152 to maintain a connection of the right-hand controller of the direction control valve 146 with atmosphere, and causes the valve 146 to be shifted rightwardly to its retract position wherein it connects the air supply line 144 to the pressure/return line 28 and the exhaust line 148 to the pressure/return line 30. Thus, the rod end of the cylinder 14 will receive pressurized air which causes the piston rod 26 to retract together with the latched impact member 78.

During retraction of the rod 26, the hammer blow delivery springs 46 will be compressed by the spring load plate 80. When the springs 46 reach their desired state of compression, as determined by the position of the trip block or cam 108, the latch hook 58 engages and is tripped by the trip block or cam 108. The impact member 78 is then released and impelled forwardly by the springs 46 so as to deliver a sharp blow to the casting riser desired to be removed. The mass and acceleration of the impact member 78 is such that it will break the riser off with very little, if any, tearing of the metal, even if some residual heat from the casting process remains in the casting. At the end of the stroke, the mass of the impact member 78 decelerates against the recoil or cushion springs 48 which stop the mass and absorb the energy created. This cushioning action is very important for isolating the operator from shock loads caused by the impact. Other known methods of cushioning could also be employed.

It is here noted that although the lower pneumatic pressure switch 186 will trip as soon as pressure builds in the rod end of the cylinder 14 when loading the springs 46, no pilot air will be routed to the upper controller of the valve 162 since the air supply line 190 is now connected to atmosphere by way of the valve 164.

At approximately the same time that the impact member 78 is released from the piston rod 26, the operator releases the push buttons 232 and 234 of the on-off valves 228 and 230 thereby turning them "off" and, thus, disconnecting pilot air from the controllers of the logic valves 204 and 206. This establishes the condition in the pneumatic control circuit 140 illustrated in FIG. 8. Specifically, it can be seen that the logic circuit 202 no longer establishes pilot air flow to the controller of the control valve 152, thus permitting the spring 154 of the latter to shift it leftwardly to its normal position wherein it connects the pilot air supply line 150 to the pilot air feed line 158 and through ports of the upwardly shifted valves 162 and 164 which act to establish a path to the right-hand controller 160 of the direction control valve 146. The pilot air acts on the controller 160 to shift the valve 146 leftwardly to its "extend" position wherein it connects the operating air supply line 144 to the pressure/return line 30 to effect extension of the piston rod 26.

Figure 9:
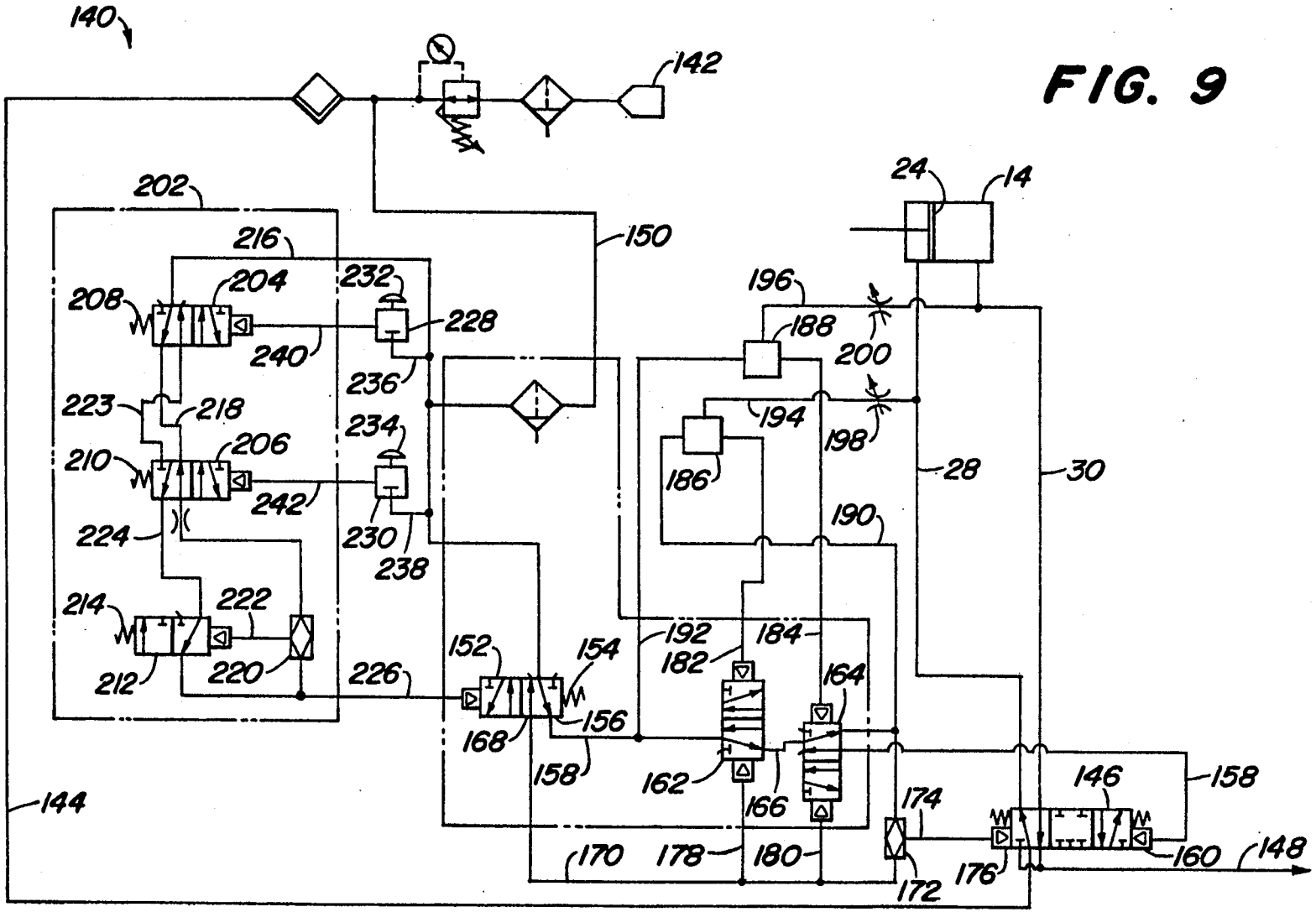

As the piston 24 approaches the end of its stroke, air pressure will build in the head end of the cylinder 14 and trip the upper pressure switch 188. As shown in FIG. 9, this results in the pilot air feed line 158 being connected to the line 184 which leads to the upper controller of the valve 164 resulting in the latter shifting downwardly to connect the right hand controller 160 of the valve 146 to atmosphere while simultaneously connecting the pilot pressure feed line 158 to the line 190 leading to the lower pressure switch 186, which is not tripped at this time since low pressure exists in the rod end of the cylinder 14. The pressure in the line 190 is also connected to the upper port of the shuttle valve 172 which acts to connect pressure to the left-hand controller 176 of the direction control valve 146. With pressure present in the controller 176, the valve 146 shifts rightwardly to its "retract" position wherein it connects the operating air supply line 144 to the pressure/return line 30. The piston rod 26 then begins to retract.

When the spring load plate 80 begins to compress the springs 46, pressure will begin to increase in the rod end of the cylinder 14 and causes the lower pressure switch 186 to trip and thus connect the source of pilot air now in the line 190 to the line 182 leading to the top controller of the left-hand valve 162. The valve 162 will then shift downwardly so as to interrupt the connection of the feed line 158 with the line 190. This also results in the line 190 and the left-hand controller of the control valve 146 being connected to atmosphere. The direction control valve 146 is then returned to its neutral position which completes the cycle of operation of the hammer 10. The control circuit 140 is now in its initial condition, shown in FIG. 6, wherein it is ready for the initiation of a new cycle by the operator pressing the push buttons 232 and 234.

Thus, it will be appreciated that the hammer 10 provides an effective way for degating castings which requires very little exertion of effort by the operator and which removes the danger of the operator or by-standers being injured due to mis-hits or flying metal particles.

We claim:

1. In a pneumatically controlled degating hammer including a pneumatic piston and cylinder unit, a pneumatic control circuit coupled to the piston and cylinder unit for effecting retraction and extension of a piston rod of said unit, the improvement comprising: an impact member being reciprocably mounted ahead of and coaxially with said piston rod; said impact member and said piston rod each carrying elements cooperating to define a releasable latch means for releasably coupling the piston rod to the impact member; at least one coil compression impact delivery spring being located in the path of movement of said impact member when the latter is retracting together with said piston rod whereby energy is stored in the impact delivery spring during retraction of the piston rod when the impact member is releasably attached thereto; and latch trip means located for effecting release of said latch means when the piston rod has retracted sufficiently to effect a predetermined loading of said spring means whereby said impact delivery spring will cause said impact member to be impelled forwardly once the latter is disconnected from the piston rod; and stop means for limiting the forward travel of said impact member.

2. The degating hammer defined in claim 1 wherein said latch means includes a latch hook mounted to a forward end of said piston rod for movement between latched and unlatched positions; said latch hook including a downwardly opening latch receptacle; a latch spring means connected to said latch hook and yieldably urging the latter towards its latched position; a latch member shaped complimentary to said latch receptacle and being located at a rear end location of said impact member for engagement by said latch hook to thereby establish a connection between the impact member and said piston rod; and said latch trip means being located in the path of movement of said latch hook when the latter is being retracted together with said piston rod, the latch trip means being operable for effecting movement of said latch hook from its latched to its unlatched position during rearward movement of said latch hook,

3. The degating hammer defined in claim 2 wherein said latch trip means is adjustable so as to release the latch hook from the latch member when different desired loading of said at least one coil compression impact delivery spring has taken place.

4. The degating hammer defined in claim 1 wherein said stop means includes a cushioning means located in a path of forward movement of said impact member for absorbing some of the impact force delivered by the impact member.

5. The degating hammer defined in claim 1 wherein a cylinder of said cylinder and piston unit includes a forward end plate; a rear spring guide plate being fixed to said forward end plate; a support structure extending forwardly from and having a rearward end fixed to said rear spring guide plate; a forward spring guide plate being fixed to said support structure in fore-and-aft alignment with said rear spring guide plate; at least one spring guide rod extending between and being mounted to said rear and front spring guide plates; and said at least one coil compression impact delivery spring being mounted on said at least one spring guide rod; and said impact member including a spring load plate slidably mounted on said at least one spring guide rod forwardly of said at least one compression spring whereby said spring load plate compresses said spring when the impact member is coupled to and retracts with said piston rod.

6. The degating hammer defined in claim 5 wherein said at least one spring guide rod is one of a plurality of guide rods; and said at least one coil compression impact delivery spring being one of a plurality of coil compression springs respectively mounted on said plurality of guide rods for being compressed by said spring load plate during retraction of said piston rod.

7. The degating hammer defined in claim 5 wherein said stop means includes a coil compression spring mounted on said at least one spring guide rod between the forward spring guide plate and the spring load plate.

8. The degating hammer defined in claim 5 wherein said support structure includes a cylindrical housing having rear and forward ends respectively fixed to said rear and forward spring guide plates; and said forward spring guide plate and said spring load plate each being cylindrical.

9. The degating hammer defined in claim 8 wherein a plurality of spring guide rods have opposite ends connected to the rear and forward spring guide plates at equi-angularly spaced locations within said guide plates; and each spring guide rod having a coil compression impact delivery spring, with one spring being said at least one impact delivery spring, mounted thereon.

10. The degating hammer defined in claim 8 wherein said load plate is provided with at least one opening for permitting air to pass from one side of the load plate to the other as the load plate moves within said cylindrical housing.

11. The degating hammer defined in claim 1 wherein said control circuit comprises:

(a) a source of air pressure;

(b) a logic circuit connected to said source;

(c) a pilot-operated, three-position, normally spring-centered direction control valve connected to said source and to said piston and cylinder unit and having extend and retract controllers at the opposite ends thereof;

(d) manually operable valve means connected to said source and to said logic circuit and operable for establishing a start input signal at said logic circuit with said logic circuit being operable in response to receiving said start input signal to establish a start output signal;

(d) a pilot air control circuit connected to said source, to said logic circuit for receiving said output signal and to said extend and retract controllers of said direction control valve, with an initial state being established in said control circuit, in the absence of said output signal, wherein the extend and retract controllers are connected to atmosphere;

(e) said pilot air circuit being operable to a second state, in response to receiving said output signal, for connecting said source to said retract controller while connecting said extend controller to atmosphere, to thereby shift the direction controller to a retract position wherein it connects said source to effect retraction of said piston and cylinder unit;

(f) said pilot air circuit further including pressure sensing means operable in response to pressure retracting said piston and cylinder unit, in conjunction with a termination of said output signal, to effect a third state in said pilot air circuit wherein said extend controller is connected to said source and the retract controller is connected to atmosphere whereby the direction control valve shifts to connect said source to effect extension of said piston and cylinder unit; and (g) said pressure sensing means being operable in response to pressure extending said piston and cylinder unit, in conjunction with the absence of said output signal, to effect said initial state in said pilot air circuit wherein both the extend and retract controllers are connected to atmosphere to thereby permit the direction control valve to be returned to its normal neutral position blocking air flow to and from the piston and cylinder unit.

12. The degating hammer defined in claim 11 wherein said manually operable valve means comprises a pair of on-off valves, each having an inlet connected to said source and an outlet connected to a signal inlet of said logic circuit and being operable from a normal off position blocking the source from said signal inlet to an on position connecting the source to said signal inlet; and said logic circuit including valve means operable for establishing said output signal only in response to simultaneously receiving signals at said inlets.

13. The degating hammer defined in claim 11 wherein said pilot air control circuit includes a two-position, pilot-operated valve coupled to said source and to said extend and retract controllers of the direction control valve, by way of extend and retract feed lines, and having a controller connected for receiving said output signal from said logic circuit; said pilot operated valve being biased to a normal position coupling said extend feed line to the source while coupling said retract feed line to atmosphere and being shifted, in response to receiving said output signal, to an operated position connecting said retract feed line to said source while connecting said extend feed line to atmosphere.

* * * * *